United States Patent [19]

Lockett

[11] Patent Number: 4,687,459

[45] Date of Patent: Aug. 18, 1987

[54] BABY TOY

[76] Inventor: G. Jeffrey Lockett, 100 South Third, St. Charles, Mo. 63301

[21] Appl. No.: 795,546

[22] Filed: Nov. 6, 1985

[51] Int. Cl.[4] ..... A63H 3/04

[52] U.S. Cl. ..... 446/268; 446/374; 446/310

[58] Field of Search ..... 446/268, 321, 324, 369, 446/374, 373, 487, 491, 73, 72, 310, 269, 75

[56] References Cited

U.S. PATENT DOCUMENTS

| | | | |
|---|---|---|---|
| 152,250 | 6/1874 | Powers | 446/487 X |
| 3,471,964 | 10/1969 | Cherry et al. | 446/268 |
| 3,830,012 | 8/1974 | Franke | 446/321 |
| 4,413,442 | 11/1983 | McSweeney | 446/369 X |

*Primary Examiner*—Mickey Yu

[57] ABSTRACT

An imaginary humanoid toy is disclosed including a body portion and a shell portion. The shell portion includes a plurality of arcuate shell segments, each of which is pivoted about a pair of ears on the body portion. In a first position the humanoid figure is located within the shell portion and is covered. In another position the segments are pivotable about the ears of the body to reveal some or all of the humanoid body including legs and feet. The arcuate segments are removable so that the body may be completely separated from the shell portion. Preferably the legs and feet can support the entire body and arcuate shell segments.

21 Claims, 8 Drawing Figures

BABY TOY

BACKGROUND OF THE INVENTION

British Patent No. 830,607 (March, 1960) discloses a baby pivotably mounted within a container which generally resembles a bed.

U.S. Pat. No. 3,627,322 (Dec., 1971) discloses a protective helmet used with a movable soccer player for use in a table soccer game in which the helmet is pivotably mounted about the ears of the table soccer player.

U.S. Pat. No. 3,686,894 (August, 1972) discloses as in a piece of jewellery, a locket having a transparent front and containing a toy figure within the locket which is removable.

SUMMARY OF THE INVENTION

An imaginary humanoid toy is disclosed including a body portion and a shell portion. The shell portion includes a plurality of arcuate shell segments, each of which is pivoted about a pair of ears on the body portion. In a first position the humanoid figure is located within the shell portion and is covered. In another position the segments are pivotable about the ears of the body to reveal some or all of the humanoid body including legs and feet. The arcuate segments are removable so that the body may be completely separated from the shell portion. Preferably the leg and feet can support the entire body and arcuate shell segments. Preferably reinforcements are provided in the body to assist in the support.

THE DRAWINGS

DESCRIPTION OF PREFERRED EMBODIMENTS

Figure 1:
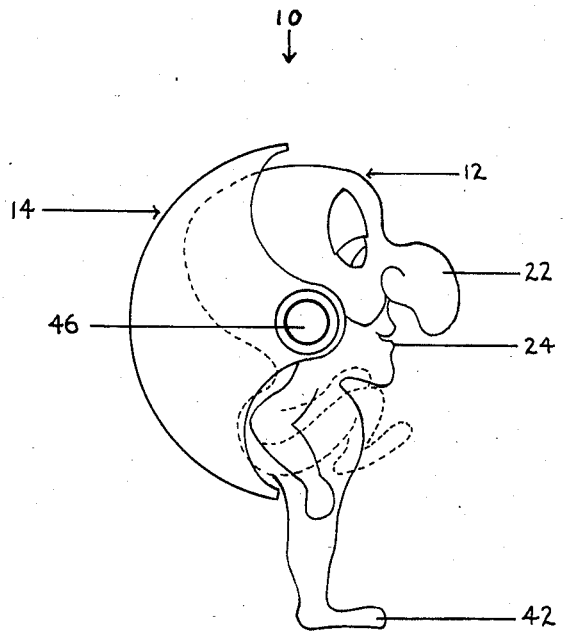
FIG. 1 is a side elevation of the toy of the present invention with the toy's legs extended illustrating the body supporting the shell portion.

The imaginary humanoid toy of the present invention is indicated in the drawing generally at 10. The toy includes a body portion 12 and a shell portion 14.

The body portion 12 includes a head 16 having enlongated eyes 18, with eyeballs 20 at the lower portion thereof. An enlarged nose is indicated at 22, and a mouth is indicated at 24.

The main body portion 26 includes a pair of arms 28 and 30 extending outwardly from a chest and shoulder portion 32, which joins a mid-section or stomach portion 34. Legs 36 and 38 depend therefrom having feet 40 and 42 respectively attached thereto.

Enlarged outwardly extending ears 44 and 46 provide pivot points for the shell portion 14.

Figure 3:
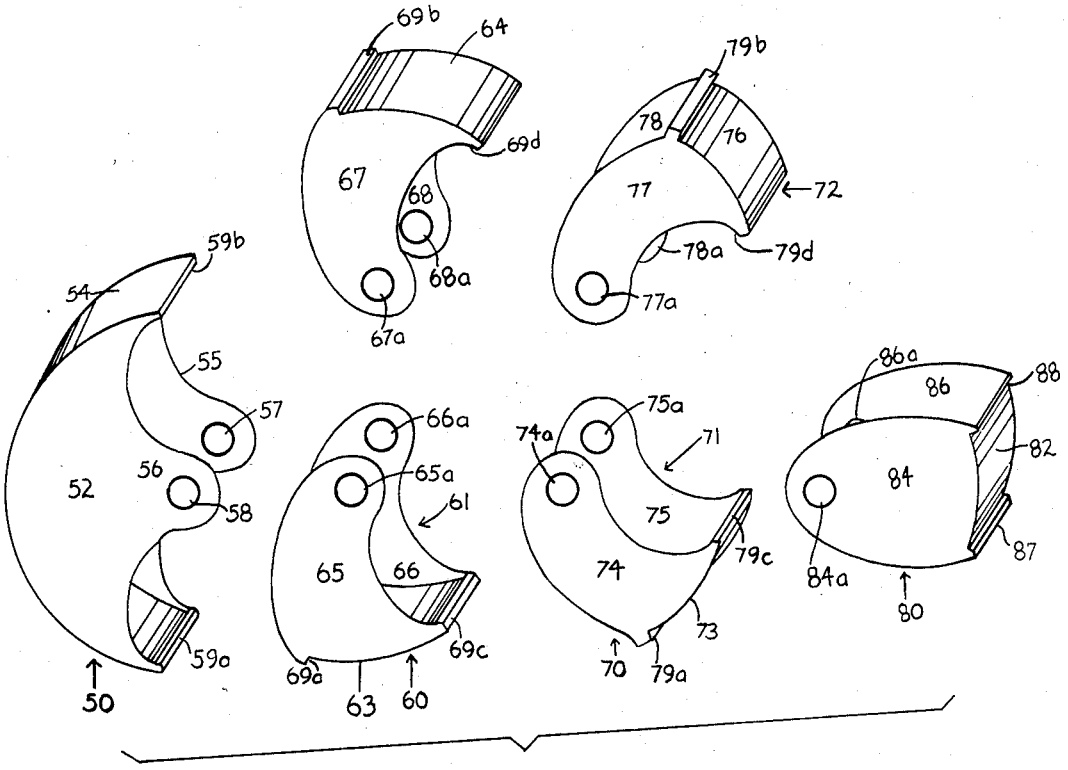
FIG. 3 is a schematic perspective view of the arcuate segments used in the shell portion of the present invention.
Figure 4:
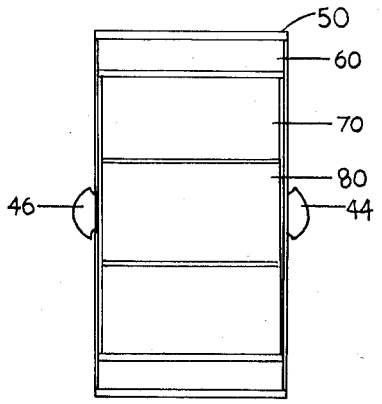
FIG. 4 is a view looking in the direction of the arrows along the lines 4—4 in FIG. 5 and illustrating the concentric relationship of the segments about the toy's ears in the present invention.

The shell portion 14 includes a plurality of arcuate segments 50, 60, 70 and 80 as shown in FIG. 3. Segments 60 and 70 are each in two parts, 61 and 62, and 71 and 72; parts 61 and 71 are mirror images of parts 62 and 72 respectively. As shown in FIG. 4, these arcuate segments are concentrically orientated with the arcuate segment 50 being outermost. The segment 60 is located within arcuate segment 50. The arcuate segment 70 is located within the segment 60 and the segment 80 is located within the segment 70. In the "open" position, 80 nests in 70, 70 nests in 60, 60 nests in 50.

Arcuate segment 50 includes a curved body portion 52 including an external wall portion 54, and sides 55 and 56 each of which contains respective connecting openings 57 and 58 (FIG. 3) for ear attachment. An inner rib 59*a* and an inner rib 59*b* are provided to prevent segment 60 from moving completely out of segment 50 in the closed position in that the inner ribs 59*a* and 59*b* contact and cannot pass the outer ribs 69*a* and 69*b* of segment 60.

Parts 61 and 62 respectively include arcuate wall portions 63 and 64 which are struck from the same radius. Arcuate segment 61 includes arms 65, and 66, each of which contain an attachment opening 65*a*, 66*a*, respectively. Segment 62 includes arms 67 and 68 each of which contains an opening 67*a*, 68*a*, for ears attachment. Outer rib 69*a* engages inner rib 59*a* in the closed position. Outer rib 69*b* engages inner rib 59*b* in the closed position.

Segment 70 is also provided in two parts 71 and 72. Part 71 includes a wall portion 73 jointed by arms 74 and 75 each having ear attachment openings 74*a* and 75*a*. Part 72 includes a wall portion 76 joined by arms 77 and 78, each of which contains an attachment opening 77*a* and 78*a*, respectively. Wall portions 73 and 76 are struck from the same radius. In closed position outer rib 79*a* engages inner rib 69*c* and outer rib 79*b* engages inner rib 69*d*.

Segment 80 includes a wall portion 82 integrally connected to arms 84 and 86, each of which is provided with an opening 84*a*, 86*a*, for ear attachment. In closed position, outer rib 87 engages inner rib 79*c* and outer rib 88 engages inner rib 79*d*. Outer rib 88 is rounded and does not protrude as far from the wall surface 82 as does rib 87. This allows the shell to be held in a closed position and, with slight pressure, to be opened at the joint between ribs 79*b* and 88.

As is apparently from a consideration of FIGS. 3 and 4, wall portion 54 is struck from a radius of curvature which is greater than the radius of curvature from which arcuate wall portions 63 and 64 are struck. Similarly, wall portions 73 and 76 are struck from a radius of curvature which is smaller than radius of curvature from which arcuate wall portions 63 and 64 are struck from. Furthermore, wall portion 82 is struck from a radius of curvature which is smaller than the radius of curvature from which arcuate wall portions 73 and 76 are struck from. This enables the concentric relationship illustrated in FIG. 4.

Figure 2:
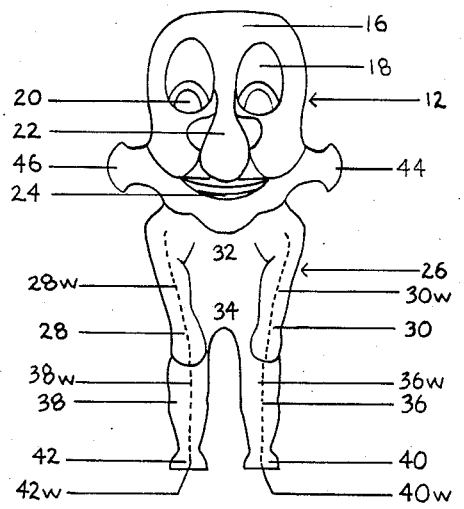
FIG. 2 is a view of the body portion with the shell removed.

The segment portions 50, 60, 70 and 80 are dimensioned such that the openings for attachment in each of the segment portions align and are adopted to be located upon the ears 44 and 46 illustrated in FIG. 2. The portions 50, 60, 70 and 80 are made of relatively strong plastic and are relatively rigid. The body portion 12 on the other hand is made of elastomeric material, which is rugged but relatively flexible. Thus the ears deform as they are extended through the attachment openings.

The legs 36 and 38 are movable about the stomach portion 34. Therefore, in one position the body portion 12 may assume the position shown in FIG. 7 wherein the legs 36 and 38 are folded in upon the stomach portion 34. Body and stomach portions 32 and 34 are also movable relative to head 16. Arms 28 and 30 are movable relative to body and shoulder portion 32. In the positions shown in FIG. 7 all of the segments 60, 70, 80 are located within the large arcuate segment 50.

Figure 5:
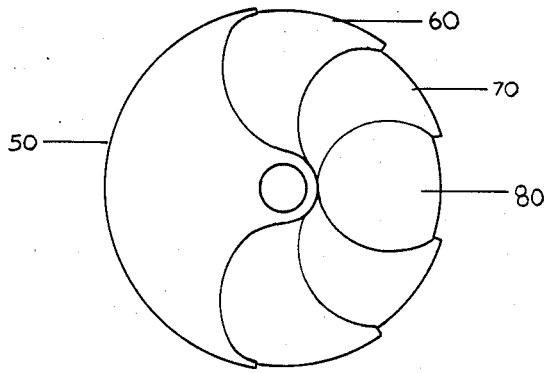
FIG. 5 is a side elevation view illustrating the arcuate segments in the fully extended (closed) position.
Figure 6:
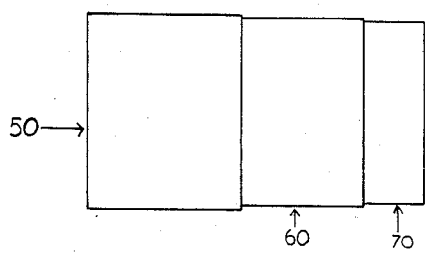
FIG. 6 is a plan view of FIG. 5, and looking in the direction of the arrows along the lines 6—6 in FIG. 5.

In order to protect the body, it is possible to move the arcuate segments into the position shown in FIG. 5 wherein the body is located completely within the extended arcuate segments 60, 70 and 80 in addition to the segment 50.

It is believed that the flexibility of this toy is both interesting and educational to a child. The dimension of the openings for connection in the segments 50, 60, 70 and 80 is preferably such that the segments will remain in a given position because there is friction between the ear portions and the openings. The child therefore can appreciate the concentric nature of the movable shell pieces.

Figure 7:
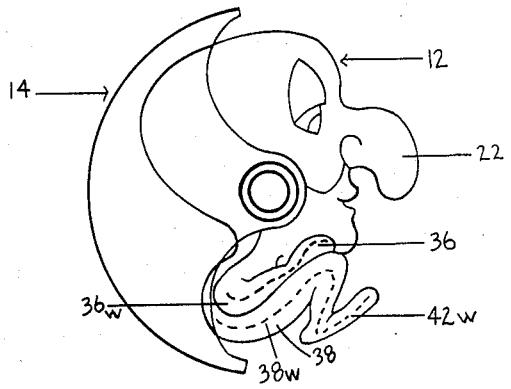
FIG. 7 is a side-elevation view illustrating the body in tucked position and the shell portion in the retracted (open) position.
Figure 8:
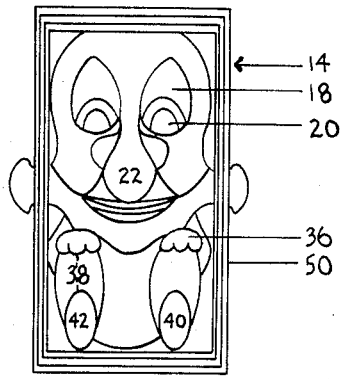
FIG. 8 is a view looking in the direction of the arrows along the line 8—8 in FIG. 7.

Furthermore, the location of the body within the shell, in the position shown in FIG. 7, is similar to an embryo. It is likely that this will stimulate discussion with the child's associates or parents concerning formation and birth of children.

As shown in FIG. 2, the body portion 12 is completely removable and self-supporting from the egg or shell portion 14. Metal wire leg supports 36*w*, 38*w* and wire feet supports 40*w* and 42*w* may be provided which facilitate the self supporting nature of the body portion. Wire arm supports 28*w* and 30*w* may also be provided.

There is literally an infinite number of intermediate, partially open positions wherein the segments are rotated a partial amount only, out of the segment within which they are located.

Finally, all of the segments may be rotated to the fully extended position shown in FIG. 5 wherein the inner and outer rib stops 59*a*, 69*a*; 69*b*, 39*b*; 79*a*, 69*c*; 79*b*, 69*d*; 79*a*, 69*c*; 87, 79*c* and 88, 79*d* engage. In this position the body portion 12 may be stored and protected within the shell assembly 14 of the present invention.

What is claimed is

1. An humanoid toy device comprising: a shell portion including a plurality of arcuate shell segments; a humanoid figure including a body portion and a leg portion, said figure in a first position located within said shell portion and being covered thereby; each of said arcuate segments being pivoted about a pair of ears on said humanoid figure; said arcuate segments being pivotable about said ears to reveal some or all of the humanoid body.

2. A humanoid toy according to claim 1 wherein said arcuate segments are removably attachable to said ears so that the body may be completely separated from the shell portion.

3. A humanoid toy according to claim 1, wherein said leg portion comprising a pair of legs attached to a midsection of the body and wherein the legs are pivotable about the midsection of the body, and wherein feet are provided at the bottom of the legs.

4. A humanoid toy according to claim 3 wherein said feet and legs can support the entire humanoid body and arcuate shell segments.

5. A humanoid toy assembly according to claim 1, wherein the arcuate segments, when fully extended with respect to each other, occupy a full 360° to completely enclose the humanoid figure.

6. A humanoid toy according to claim 1, wherein there exists interface between the ear portions of the body and the arcuate segments whereby the arcuate segments will remain in a desired position without additional support.

7. A humanoid toy according to claim 1, wherein the body portion is made of resilient, flexible material and the shell portion is made of relatively rigid material, whereby the body portion may be located within, or completely removed from the shell portion.

8. A humanoid toy according to claim 5, wherein each said arcuate segments is defined by a respective radius, said radii are of different lengths and are arranged to project from a common point, whereby said arcuate segments are positioned in a concentric relationship.

9. A humanoid toy according to claim 8, wherein at least one arcuate segment is a mirror image of another arcuate segment.

10. A toy according to claim 3 wherein reinforcements are provided in said legs.

11. A toy according to claim 10 wherein reinforcements are provided in said feet.

12. A toy according to claim 5 wherein stop means are provided upon adjacent arcuate segments to maintain said segments in said enclosed position.

13. A humanoid toy device comprising: a humanoid figure, including a body portion and a leg portion, and a shell portion made of a plurality of arcuate shell segments; each of said shell segments pivoted about a pair of ears on' said figure, whereby in a first position said figure is located within the shell portion and is covered, and whereby in a second position the arcuate shell segments are pivotable about the ears of the figure to reveal some or all of the figure.

14. A humanoid toy according to claim 13, wherein said leg portion comprising a pair of legs and feet.

15. A humanoid toy according to claim 14, wherein the legs and feet can support the entire body and said arcuate segments.

16. A humanoid toy according to claim 15, wherein the arcuate segments are removably attachable to said ears.

17. A toy according to claim 15 wherein reinforcements are provided in said legs.

18. A toy according to claim 17 wherein reinforcements are provided in said feet.

19. A humanoid toy device comprising: a humanoid figure and a shell portion made of a plurality of arcuate shell segments; each of said shell segments is pivotably arranged to at least one adjacent shell segment and is pivoted about a pair of ears on said figure, whereby in a first position said figure is located within an enclosed position of said shell portion and is covered, and whereby in a second position the arcuate shell segments are pivotable about the ears of the figure to reveal some or all of the figure; and stop means provided upon adjacent arcuate segments to maintain said segments in said enclosed position.

20. A toy according to claim 19 wherein said stop means comprise abutting ribs on respective adjacent shell segments which engage when one segment has reached its fully extended position with respect to an adjacent shell segment.

21. A toy according to claim 20 wherein each arcuate segment includes a least one rib to hold it in place in the extended position.

* * * * *